US005303847A

United States Patent [19]

Cottone

[11] Patent Number: 5,303,847

[45] Date of Patent: Apr. 19, 1994

[54] TOY DISPERSING WATER FROM FINGERTIP SHEATH

[75] Inventor: Sam Cottone, Chicago, Ill.

[73] Assignee: Talk To Me Products, Inc., Syosset, N.Y.

[21] Appl. No.: 43,396

[22] Filed: Apr. 5, 1993

[51] Int. Cl.[5] ..... B67D 5/64

[52] U.S. Cl. ..... 222/78; 222/175; 222/333; 239/154; 239/332; 239/529; 446/475

[58] Field of Search ..... 222/78, 79, 175, 333; 239/154, 153, 152, 529, 332; 2/16, 159, 160, 168, 170; 4/615; 446/26, 473, 475, 483

[56] References Cited

U.S. PATENT DOCUMENTS

| | | | |
|---|---|---|---|
| 1,177,412 | 3/1916 | Hopkins | 239/529 |
| 1,533,732 | 4/1925 | Frost | 239/529 |
| 3,901,449 | 8/1975 | Bochmann | 239/332 |
| 4,037,790 | 7/1977 | Reiser et al. | 222/175 X |
| 4,392,594 | 7/1983 | Swett et al. | 222/530 |
| 4,768,681 | 9/1988 | Dean et al. | 222/79 |
| 4,903,864 | 2/1990 | Sirhan | 222/78 |
| 4,997,110 | 3/1991 | Swenson | 222/175 |
| 5,072,856 | 12/1991 | Kimble | 222/78 |
| 5,158,208 | 10/1992 | Wilson | 222/78 |

*Primary Examiner*—Kevin P. Shaver
*Attorney, Agent, or Firm*—Gerard F. Dunne

[57] ABSTRACT

A device worn on a user's hand which sheaths for the tips of the fingers includes a housing for a water reservoir, a water pump and electrical motor and a battery pack to be secured to the user's body. An actuator is mounted is mounted on a finger sheath. When the actuator is depressed the motor drives the pump to eject water in spurts from a discharge nozzle mounted in a second finger sheath.

7 Claims, 3 Drawing Sheets

TOY DISPERSING WATER FROM FINGERTIP SHEATH

FIELD OF THE INVENTION

The present invention relates to a water toy and in particular, to a toy affixed to a user's hand and body for ejecting water under pressure by selective activation of a pump.

BACKGROUND OF THE INVENTION

Water guns are popular toys which typically squirt water under pressure when a user depresses a trigger. Devices such as that proposed by U.S. Pat. No. 4,022,350 are known which include a battery-powered pump so that, upon actuation of the trigger, the water can be pumped automatically. Conventional water guns are typically held in the hand, and its is an object of the present invention to enhance play value by providing a battery-operated water toy which is worn on a user's hand and body rather than held in the user's hand.

In order to accomplish these and other objects, in one aspect of the present invention, the device comprises a housing adapted to be affixed to a belt worn by the user. The housing contains a reservoir fillable with a fluid, particularly water, as well as a fluid output port. An electrically driven pumping means is located in the housing and is operative for conveying the water under pressure from the reservoir through the output port an elongated flexible transport tube. An electrical power source, e.g., a battery pack, is also provided in the housing and supplies electrical power to the pumping means.

A targeting sheath is provided for securing to one of the user's fingers. The targeting sheath includes a discharge nozzle connected to the flexible transport tube for the discharge of pressurized fluid therefrom.

An actuator sheath is provided for securing to another finger of the user. The actuator sheath includes an actuating switch electrically connected between the power source and the pumping means, and is operative for selectively actuating the pumping means to eject the fluid away from the discharge nozzle mounted in the targeting sheath.

A fingerless glove is worn on the user's hand. The glove contains at least one slot for compressive retention of the flexible transport tube in order to prevent the targeting sheath and actuator sheath from falling from the user's fingers.

The targeting and actuating sheaths are snugly worn on the user's fingers and the elongated transport tube is secured in place by the glove, which is snugly worn on the user's hand. During use, the user need only point his finger on which the targeting sheath is mounted in the direction of a selected target, and depress the actuating switch. An electrical connection is made between the power source and the pumping means, thereby commencing the conveying of pressurized fluid from the discharge nozzle to the target.

The novel features which are considered characteristic of the invention are set forth in particular in the appended claims. The invention itself, its construction and its method of operation, together with additional objects and advantages thereof, will be understood from the following description of specific embodiments when read in connection with the accompanying drawings.

DETAILED DESCRIPTION OF THE PREFERRED EMBODIMENTS

Figure 1:
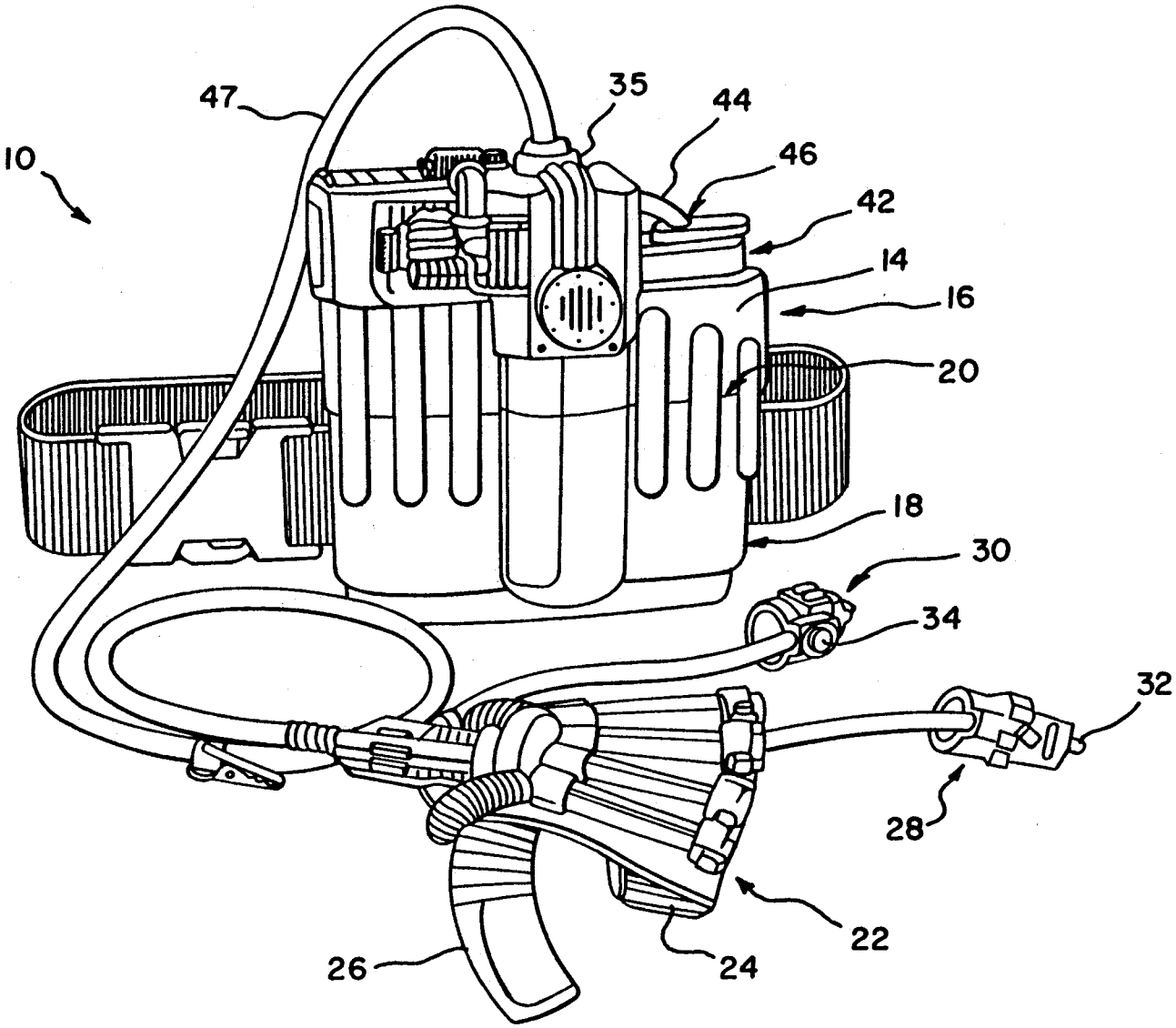
FIG. 1 is a front view of a water dispersing toy in accordance with the present invention.

FIG. 1 illustrates the water toy device 10 of the present invention which includes a housing 14 having an upper part 16 and a lower part 18 which are joined together along a common separating line 20. The housing is made of an injection or blow-molded synthetic plastic material, preferably of high-impact resistance and durability.

A pair of finger sheaths 28, 30 are included. The targeting finger sheath 28 contains a narrow-diameter discharge nozzle 32 mounted at the tip thereof from which fluid is discharged. An actuating finger sheath 30 is worn on another of the user's fingers, preferably on the same hand, and has a conventional electrical contact switch 34 mounted therein such that the switch button is exposed and readily accessible by the user. As will be described below, the electrical contact switch 34 is electrically connected to the pumping means to permit the selective discharge of fluid from the device.

Preferably, the finger sheaths 28, 30 are fabricated of a flexible resinous material and are of shape-retaining form such that the sheaths are properly retained on the user's fingers. Advantageously, the inner surface of the sheaths are tapered to accommodate varying finger sizes such that each sheath may be worn on any one of the user's fingers. Such construction also permits use of the device by users having small or large fingers.

The device also includes a glove 22 which is secured to a hand of a user by means of an elastic strap 24 and an adjustable strap 26 to accommodate a variety of hand sizes. The glove 22 is fabricated of a flexible material, i.e., a thin-layered synthetic material.

Figure 2:
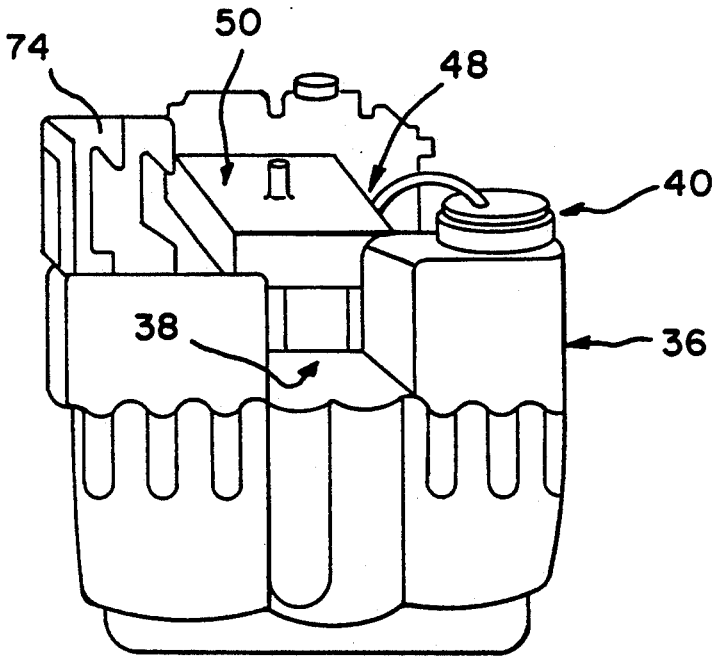
FIG. 2 is a partially exploded view of the housing of FIG. 1.

As illustrated by FIG. 2, a reservoir tank 36 defined by containment wall 38 is mounted within the lower part 18 of the housing 14. The reservoir tank 36 has a portion thereof extending into the upper portion of the housing 14 and includes a threaded annular offset 40 extending above the upper surface of the housing 14 and a threaded cap 42 which may be screwed on the offset 40 to accomplish the selective opening or closing of the reservoir tank 36. When the cap 42 is removed from the offset 40, fluid, particularly water, may be introduced into the reservoir tank 36 from any available water supply. When the cap 42 is again tightened on the offset 40, undesired leakage of fluid from the reservoir tank 36 is prevented.

An output port 35 is provided atop the housing 14 and has connected thereto one end of an elongated flexible tube 47. The opposite end of the elongated flexible tube 47 is connected to the discharge nozzle 32 for conveyance of pressurized water from the reservoir tank 36 to the discharge nozzle 32.

Figure 3:
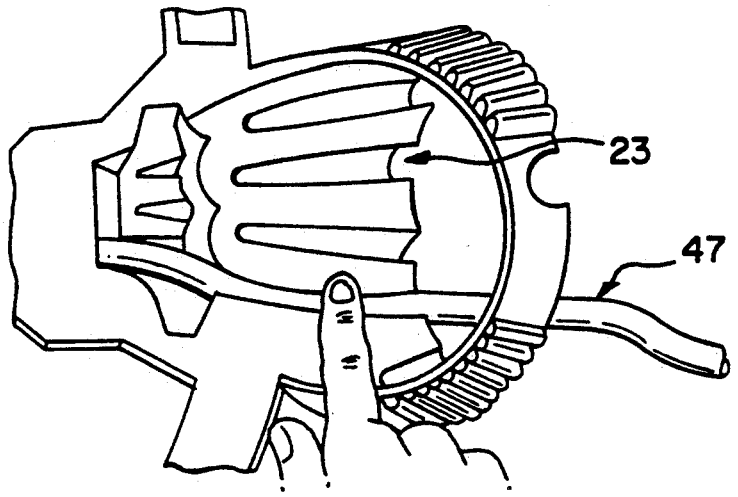
FIG. 3 is a bottom elevation view of the glove.

As illustrated in FIG. 3, the lower or inner surface of the glove 22 is provided with a plurality of longitudinally extending slots 23. Each slot 23 permits the compressive engagement of the elongated flexible tube 47 therein such that when the targeting sheath 30 is secured over a selected fingertip of the user, the glove retains the elongated transport tube 47 in alignment with the selected finger and the sheath 30 is held securely in place. As illustrated, one slot 23 is provided in alignment with each respective finger location such that the elongated tube 47 may be placed in the slot 23 corresponding to the finger of the user upon which the targeting sheath 30 is secured.

Water in the reservoir tank 36 is withdrawn therefrom through the flexible feed tube 44 extending from the reservoir 36 through a hole 46 in the cap 42 and is connected to an input port 48 of a conventional water pump 50. Water pumps for use in water guns and the like are well known, such as the geared-down reciprocating pump disclosed in U.S. Pat. No. 4,022,350 which is fully incorporated herein by reference. Substantially the same pump means may be utilized in the present invention and the internal construction and operation thereof are thus known.

Figure 4:
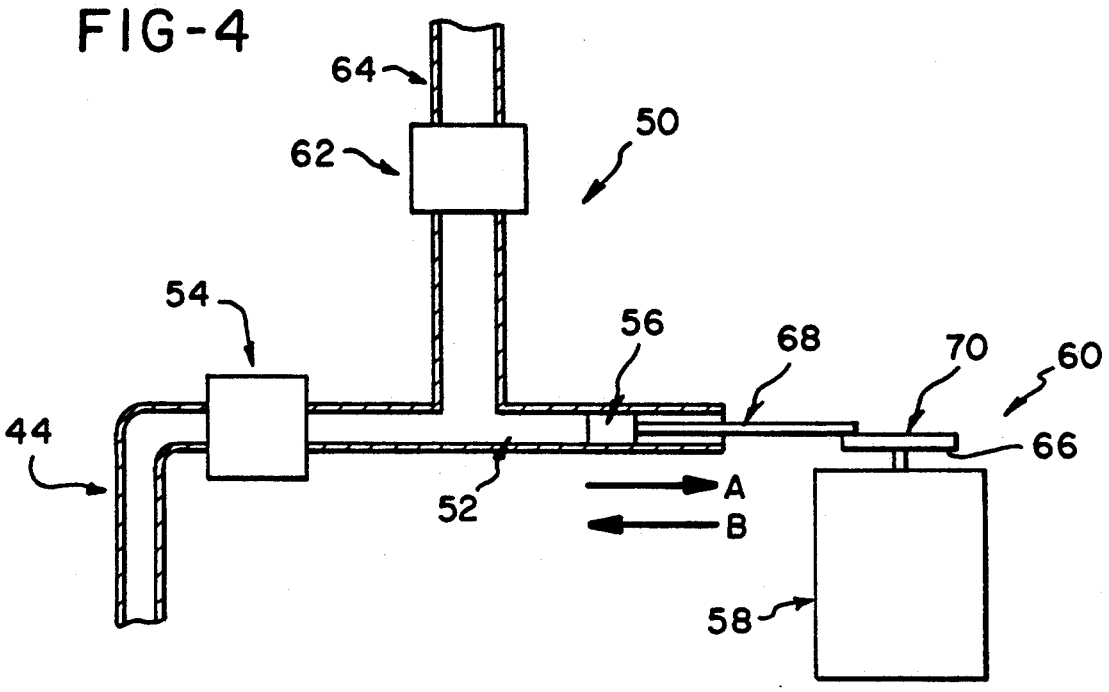
FIG. 4 is a schematic view of the pumping means illustrating the operation thereof.

In particular, as illustrated in FIG. 4, the flexible feed tube 44 is connected to a cylinder 52 by way of an inlet valve assembly 54. The inlet valve assembly 54 is a one-way valve which is open and permits fluid to flow from the flexible feed tube 44 into the cylinder 52 when a low pressure condition exists in the cylinder 52, and which is closed and prevents fluid from entering the cylinder 52 when a high pressure condition exists therein. When the pump 50 is activated, low and high pressure conditions within the cylinder 52 are alternatingly and repetitively generated by a piston 56 which is reciprocatingly driven by an electrical motor 58 in cooperation with a transmission linkage 60. When the piston 56 is reciprocated, alternating low and high pressures are produced within the cylinder 52. When low pressure is produced by the withdrawing of the piston 56 from the cylinder 52 (in the direction of arrow A in FIG. 4), water is drawn from the reservoir tank 36 through the flexible feed tube 44 into the cylinder 52. When the piston 56 is forced into the cylinder 52 (in the direction of arrow B in FIG. 4), a high pressure condition is created in the cylinder 52, whereupon the inlet valve assembly 54 is closed and fluid is prevented from flowing backward through the flexible feed tube 44 into the reservoir 36. Instead, the water is discharged through an outlet valve assembly 62 to an pump outlet port 64 also in direct communication with the cylinder 52. The output valve assembly 62, like the input valve assembly 54, is a one-way valve, operating in the opposite manner to the input valve 54. Thus, when a low pressure condition exists, the outlet valve assembly 62 is closed and the inlet valve assembly 54 is open. When a high pressure condition exists, however, the outlet valve 62 is open and the inlet valve assembly 54 is closed.

The electrical motor 58 is of conventional construction, and has an output shaft 66 which rotates at relatively high speeds. The shaft 66 extends into, and is geared down by a transmission linkage 60, which converts the high rate of rotation of the output shaft 66 in to a correspondingly high torque of a drive shaft 68. The drive shaft 68 is eccentrically mounted to the output shaft 66 via drive cam 70.

Thus, as the motor output shaft 66 rotates rapidly, the piston 56 is reciprocated at a slower rate and greater force due to its radial offset from the center of the output shaft 66. The cam 70 rotates in accordance with the drive shaft 68 and in doing so, it forces the piston 56 to reciprocate in and out of the cylinder 52. Each cycle of the piston 56, which operates in accordance with the foregoing description, causes an amount of water to be drawn from the reservoir tank 36 through the feed tube 44 and forces the water under pressure to exit from the pump outlet port 64.

Figure 5:
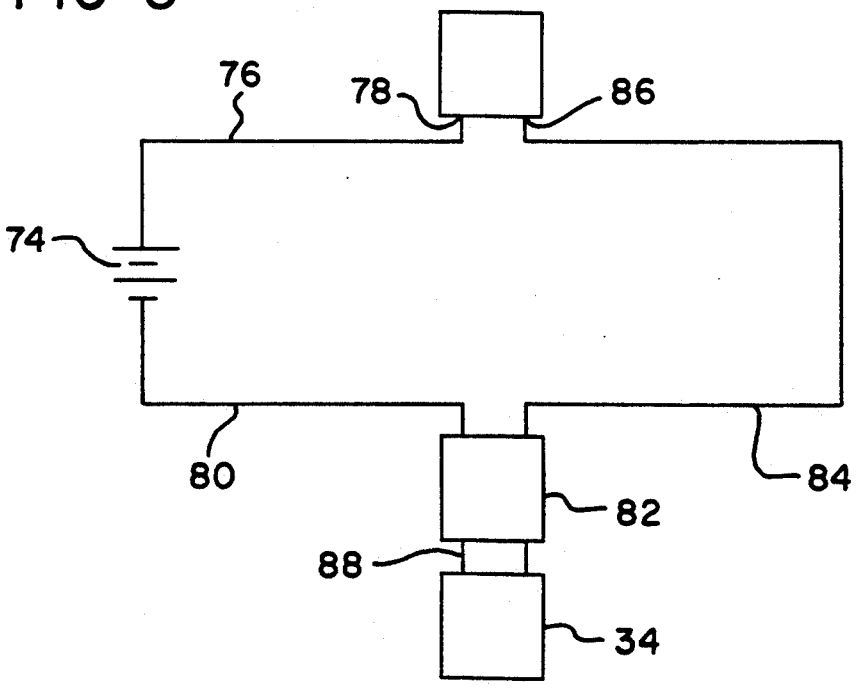
FIG. 5 is a schematic diagram illustrating the electrical control circuit of the device.

In order to energize the electrical motor 58, an electrical power source, i.e., a battery pack 74, is mounted in a separate compartment within the upper part 16 of the housing 14. As schematically illustrated in FIG. 5, a first electrical wire 76 extends from one end of the battery pack 74 to a first conductive socket 78 on the motor 58. A second electrical wire 80 extends from the opposite end of the battery pack 74 to a first socket of a conductive connector 82. A third wire 84 is connected to a second socket of the conductive connector 82 and extends to a second conductive socket 86 on the motor 58. To complete the electrical interconnection between the motor 58 and the battery pack 74, actuator means are connected, via a pair of electrical wires 88, between the first and second sockets of the conductive connector 82. As discussed above, the actuator means is mounted in the actuating finger sheath 30 and comprises a normally open electrical momentary contact switch 34 which, when depressed, causes activation of the motor 58 and pump 50 in the aforementioned manner.

The wire pair 88 connecting the actuator switch 34 and the conductive connector 82 are enclosed in an sheath 90 which extends coaxially over the elongated flexible tube 47. The sheath 90 terminates at conduit 92 integrally formed on the glove 22 at which point the wires are carried in a second flexible tube 94 to the actuating sheath 30 and connected to contacts on the electrical contact switch 34.

In operation, the user inserts the finger sheaths 28, 30 over selected ones of his or her fingers. The elongated flexible tube 47 is then inserted in the slot 23 of the glove 22 which is in alignment with the finger on which the targeting sheath 28 is mounted. The housing 14 is mounted to the user's belt via the belt clip (not shown) provided on its side. It is, however, assumed that water has been added to the reservoir and that the cap 42 has been replaced prior to attachment of the housing 14 to the user's belt.

Thereupon, the user merely points his or her finger upon which the targeting sheath 28 is mounted, at any prospective target. Next, by merely depressing the actuating switch 34, the electrical motor 58 is energized and the piston 56 is reciprocated in the pump cylinder 52, thereby alternatingly and repetitively drawing water into the pump cylinder 52 and ejecting the water from the discharge nozzle 32. This operation will continue as long as the actuating switch 34 remains depressed.

While the invention has been illustrated and described as embodied in a fluid device worn by a user, it is not intended to be limited to the precise details shown above, since various modifications and structural changes may be made without departing in any way from the spirit of the present invention.

I claim:

1. A device for selectively discharging a pressurized fluid from a user's fingertip comprising:

a housing adapted to be affixed to a user's body, said housing having a reservoir adapter to contain a fluid, an output port for the discharge of fluid from said housing, an electrically driven pumping means for conveying the fluid under pressure from the reservoir to the output port, and an electrical power supply for supplying power to the pumping means;

a glove adapted to be secured to the hand of a user, said glove being without portions receiving the lengths of a user's fingers;

a first sheath adapted to be secured to the tip portion of a first finger of the user, said first sheath including a nozzle in communication with said output port for conveying fluid thereto;

an elongated flexible tube connected at one end thereof to said output port and connected at the opposite end thereof to said nozzle; and actuating means electrically connected between the power supply and the pumping means, and operative for selectively actuating the pumping means.

2. The device of claim 1, further comprising a second sheath adapted to be secured to the tip portion of a second finger of the user, said second sheath having said actuating means mounted thereon.

3. The device of claim 1, said glove having at least one slot extending from a rear portion of said glove proximate the wrist of the user, to the front portion of said glove, proximate the knuckles of the user, said at least one slot being in alignment with at least one finger such that said elongated tube as adapted to be compressively retained in one of said at least one slot in order to maintain said elongated tube in alignment with the finger selected to receive said first sheath.

4. The device of claim 1, wherein the pumping means includes a pump having a cylinder in which a piston is reciprocatingly received, an electrical motor having a rotating output shaft, and a transmission means between the output shaft of the motor and the piston for reciprocating the piston in response to rotation of said output shaft.

5. The device of claim 2, wherein the first and second sheaths are of shape retaining form and of tapered construction such that they are adapted to be secured on any of the tips of the user's respective fingers.

6. The device of claim 1, wherein the power supply is a self contained battery pack in the housing.

7. The device of claim 1, wherein the reservoir has a selectively openable and closable inlet at the exterior of the housing.

* * * * *